US008708774B2

(12) United States Patent
Diplotti

(10) Patent No.: US 8,708,774 B2
(45) Date of Patent: Apr. 29, 2014

(54) AUTOMATIC GRINDING MACHINE FOR END MILLS FOR WOOD, PROGRAMMABLE WITH OPTICAL READING OF THE GEOMETRIC CHARACTERISTICS AND COMPUTERIZED SHAPENING

(75) Inventor: Nereo Diplotti, Povoletto (IT)

(73) Assignee: Nordutensili S.R.L., Povoletto (IT)

( * ) Notice: Subject to any disclaimer, the term of this patent is extended or adjusted under 35 U.S.C. 154(b) by 0 days.

(21) Appl. No.: 14/118,306

(22) PCT Filed: May 31, 2012

(86) PCT No.: PCT/IB2012/052744

§ 371 (c)(1),
(2), (4) Date: Nov. 18, 2013

(87) PCT Pub. No.: WO2012/164522

PCT Pub. Date: Dec. 6, 2012

(65) Prior Publication Data

US 2014/0087630 A1 Mar. 27, 2014

(51) Int. Cl.
*B24B 49/00* (2012.01)
*B24B 3/06* (2006.01)

(52) U.S. Cl.
CPC ..... *B24B 3/065* (2013.01)
USPC ..... 451/5; 451/6; 451/11; 451/148

(58) Field of Classification Search
CPC ..... B24B 3/0065
USPC ..... 451/5, 6, 11, 141
See application file for complete search history.

(56) References Cited

U.S. PATENT DOCUMENTS

| | | | | |
|---|---|---|---|---|
| 3,916,582 | A * | 11/1975 | Costil | 451/48 |
| 4,115,956 | A * | 9/1978 | Huffman | 451/4 |
| 4,341,044 | A * | 7/1982 | Cross | 451/72 |
| 4,608,643 | A * | 8/1986 | Breitenstein et al. | 451/5 |
| 4,631,870 | A * | 12/1986 | Sun | 451/5 |
| 5,146,670 | A * | 9/1992 | Jones | 451/4 |
| 5,231,587 | A * | 7/1993 | Frost | 451/5 |
| 5,359,814 | A * | 11/1994 | Baltazar et al. | 451/5 |
| 5,630,747 | A * | 5/1997 | Haller | 451/11 |
| 5,871,391 | A * | 2/1999 | Pryor | 451/9 |
| 7,874,895 | B1 * | 1/2011 | Toycen | 451/11 |

FOREIGN PATENT DOCUMENTS

DE 4215419 11/1993

* cited by examiner

*Primary Examiner* — Maurina Rachuba
(74) *Attorney, Agent, or Firm* — Themis Law

(57) ABSTRACT

An automatic grinding machine for end mills for wood, programmable with optical reading of geometric features and for computerized sharpening, has a compact structure, which includes a computerized control panel actuating various assemblies adapted for automated sharpening. A first optical reading assembly has an arm for automatic movement from an inactive position to a position suited for detecting the geometric features of the end mill. A second assembly for holding the end mill is configured to move on command forward and backward and/or simultaneously rotate the mill about its own axis. A third assembly for supporting a cup grinding wheel is mounted on the vertical frame, which rests on a rotatable circular and horizontal base. The grinding wheel can move above and below, longitudinally along the mill and/or in front of it, on the right and left side to sharpen end mills for wood with a left-handed or right-handed helix.

5 Claims, 5 Drawing Sheets

AUTOMATIC GRINDING MACHINE FOR END MILLS FOR WOOD, PROGRAMMABLE WITH OPTICAL READING OF THE GEOMETRIC CHARACTERISTICS AND COMPUTERIZED SHAPENING

FIELD OF APPLICATION

The present invention relates to an automatic grinding machine for end mills for wood, programmable with automatic optical reading of the geometric characteristics of the mills to be sharpened and computerized sharpening, provided with a single profiled grinding wheel mounted on an assembly which can be oriented with respect to the mill, capable of performing the sharpening of the left-handed or right-handed helical flutes and of the respective tip cutting edges. The machine is extremely automated and can be controlled even by personnel lacking specific training but obviously aware of how the mill is mounted and removed from said machine.

The automatic grinding machine is compact and can also be mounted on adapted trolleys to allow its movement within work departments to serve other specific machines. The sharpening operations are all automatic, so that the operator only has to place the grinding wheel in the correct working position; after this, by pressing the controls from a small digital keypad, the grinding machine positions an adapted optical reader, which checks the geometry of the mill in three points: the tip, the central region and the end part toward the shank. Once the reading has been performed, it automatically synchronizes the angular rotation of the mill holder and of the mill itself and of its advancement toward the profiled grinding wheel in order to perform correct sharpening. The machine reduces the burden of checks by the operator, since it is completely automatic and ensures correct, high-quality sharpening both on the helical cutting edges of the stem and on those of the tip, by virtue of the presetting of the machine by the optical detection assembly, which determines all the movements of the mill proximate to the profiled grinding wheel.

BACKGROUND ART

Various grinding machines for end mills for wood are known in the background art. They are of the static type, fixed to the floor or of the portable type. Among the latter, a grinding machine for wood bits of the same proprietor as the present invention (Italian patent UD2009A000095 dated 15 May 2009 and PCT/1B2010/001134 dated 17 May 2010) is noted. Other machines of the portable type for metal bits are also known: DE 20 2005 005859 U1 (Taiwan More Cash Villager Corp); U.S. 2007/243801 (Liao Ming-Ko-TW); EP 2 006 052 (Taiwan More Cash Villager Corp); U.S. Pat. No. 7,473,163 B1 (Lee Wang-Scheng-TW).

As regards grinding machines of the fixed type for end mills for wood, they have one or more stations into which the mill to be sharpened is to be inserted in order to sharpen the desired cutting edge. These machines are very complex and must be operated by skilled personnel, as otherwise there is the risk of damaging the tool irreparably instead of sharpening it correctly. They are mostly operated manually and therefore the operating personnel must be very expert.

Sometimes these machines, despite being equipped with information technology methods which are known in the field, are of the fixed type and therefore cannot be moved to the various departments or to serve other machine tools; this static nature is considered a negative aspect, is scarcely practical in its use and in any case affects sharpening times and the associated costs.

In order to meet the needs of companies working in the field of wood working by chip forming/removal, in particular in the sharpening of end mills, it has been thought to provide a fully automatic machine for these sharpening operations which has a modest weight, and to make it easily movable by means of an adapted trolley to which it is to be fixed. This avoids the forming, inside factories, of an adapted sharpening department, since the machine in each instance can serve different machines.

SUMMARY OF THE INVENTION

The aim is, therefore, to provide a single automatic machine which is specialized exclusively for the sharpening of end mills for wood working, i.e., an automatic grinding machine which is easy to use even for personnel of limited skill, having the following characteristics:

- minimal space occupation, mountable on an adapted trolley to facilitate its transport within work departments to serve chip-forming wood working machines;
- provided with an automatic system for detecting geometric shapes for end mills for wood, the information of which is used by another automatic computerized actuation system (of the CNC type), provided with a data entry keypad, to perform automatically the movements of said mill in a longitudinal direction and/or in a direction of rotation about its own axis, in coordination and in cooperation with a cup grinding wheel which performs the actual sharpening;
- provided with an end mill holder support, mounted on a slider with automated motion, along a horizontal axis, which is parallel to the footing and longitudinal to said machine;
- provided with a cup grinding wheel, with a shape suitable to sharpen both the helical cutting edges along the mill and the tip cutting edges;
- provided with a grinding wheel holder assembly which is mounted on the horizontal footing, on a vertical frame capable of moving vertically with respect to the horizontal level of the mill to be sharpened, said footing being capable of rotating on a vertical axis in both directions (clockwise and counterclockwise), so as to arrange the cup grinding wheel in any one of the two sides with respect to the horizontal rotation axis of the end mill. Said assembly is provided with adapted adjustment screws for micrometric movements of the grinding wheel with respect to the mill to be sharpened.

In summary, the grinding wheel holder assembly, in addition to moving from one side of the end mill to be sharpened to the other, can move frontally with respect to the head of the mill, and is also capable of moving above and/or below the horizontal axis of the mill, in order to sharpen the helical cutting edges along the lateral surface of the end mill; it can also perform automatically the complete sharpening of end mills of the right-handed or left-handed type.

ESSENCE OF THE INVENTION

The aim and objects of the invention are achieved according to the characteristics of the main claim and/or of any other claim cited in this patent text, providing an automatic grinding machine for end mills for wood which is compact, has a limited space occupation, is of the type that is fixed and/or mountable on an adapted trolley to move it within the various departments.

The automatic grinding machine for end mills for wood comprises a body on a supporting footing, preferably on a bench or movable trolley. The machine has a data entry keypad associated with a computerized system of the CNC type, capable of controlling and actuating the various functions of the grinding machine.

A first characteristic of the grinding machine according to the invention resides in that it is provided with an assembly for the optical reading of the geometric characteristics of the end mill to be sharpened. In particular, at least three readings are taken: one at the tip, one approximately halfway along the mill, and one at the end. The data are processed by the computer system so as to program the advancement and rotation of the end mill during sharpening, in coordination and in cooperation with the cup grinding wheel adapted for said sharpening.

Another characteristic of the invention resides in that the end mill is inserted and locked in the adapted mill holder in a horizontal position, its slider moving automatically longitudinally along the axis of the mill forward and backward with respect to the cup grinding wheel, and at the same time the mill holder rotates about itself clockwise or counterclockwise depending on the type of mill to be sharpened.

According to another characteristic of the invention, the grinding wheel holder assembly rests on a horizontal circular footing and can rotate about itself on a vertical axis. Said assembly can thus move vertically and/or simultaneously rotate about its own footing and can also provide optional micrometric adjustments in the three three-dimensional axes with adapted knobs which act on micrometric screws. The cup grinding wheel holder assembly can arrange itself, with respect to the end mill to be sharpened, above and below it, perfectly parallel along the longitudinal axis of said mill and/or inclined by a chosen angle, and can also arrange itself perfectly perpendicular and/or inclined with respect to the tip cutting edges.

The sharpening step occurs, after reading the geometric configuration of the end mill, in a fully automated manner. The grinding wheel is positioned exactly in relation to the cutting edge to be sharpened; the mill approaches the abrasive grinding wheel, advancing and rotating automatically in the correct direction in relation to the helical lateral cutting edge to be sharpened, in an upward position for the upper helix and in a downward position for the lower helix, or in the case of front sharpening of the respective cutting edges at right angles, advancing and rotating slightly, always automatically. All the movements in coordination and cooperation of the optical reader, of the movements of the mill to be sharpened and of the positioning and/or actuation of the cup grinding wheel are managed by an adapted computer system which is known to persons skilled in the art (e.g., ISO system of CNC).

According to another characteristic of the automatic grinding machine of the present invention, it can work on end mills of both the right-handed type and the left-handed type: this is possible by arranging the sharpening cup grinding wheel to the right or to the left of said mill.

The grinding machine is provided with an adapted transparent safety screen to protect the use of said machine.

DESCRIPTION OF DRAWINGS

These and other characteristics of the present invention will become apparent from the following description by way of preferential but non-limiting example of embodiment in the five accompanying drawings, wherein.

Figure 1:
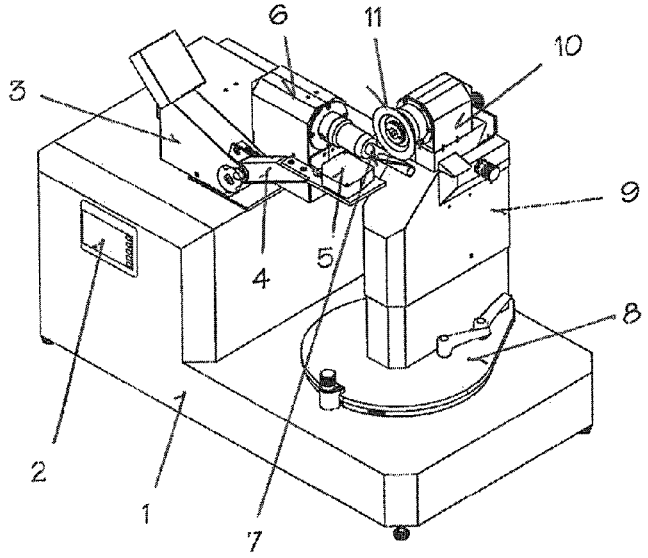
FIG. 1 is a perspective view of the automatic grinding machine for end mills for wood, highlighting the various characteristic assemblies of the machine: the computer command entry keypad; the automatic optical reader; the movable mill holder assembly and the cup grinding wheel holder assembly, capable of moving from one side to the other of the mill to be sharpened and in a vertical direction.
Figure 2:
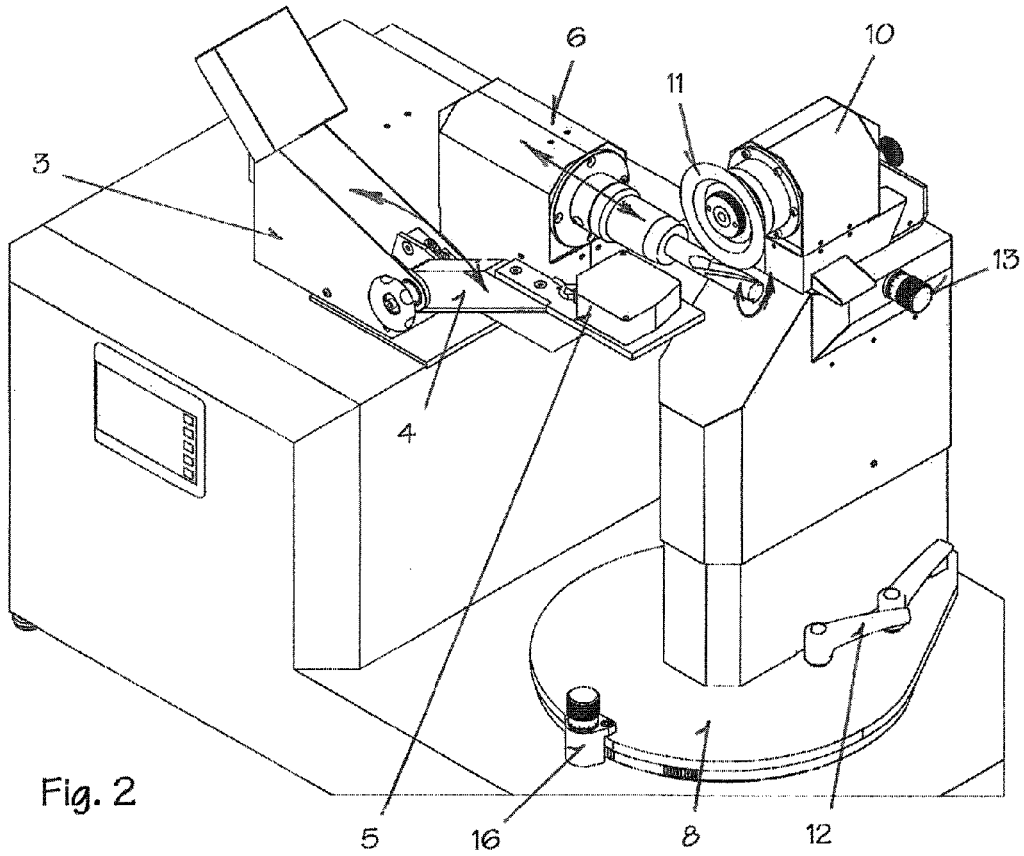
FIG. 2 is a perspective view of the same view as the preceding figure, but in enlarged scale.
Figure 3:
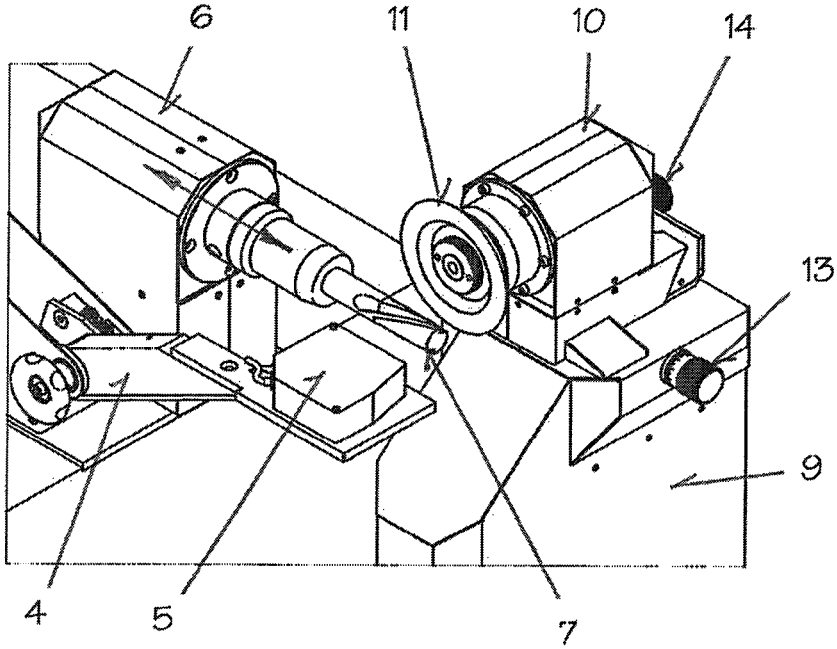
FIG. 3 is a perspective view of the optical reading assembly of the end mill in the end position of the mill with the cup grinding wheel assembly adjacent thereto.
Figure 4:
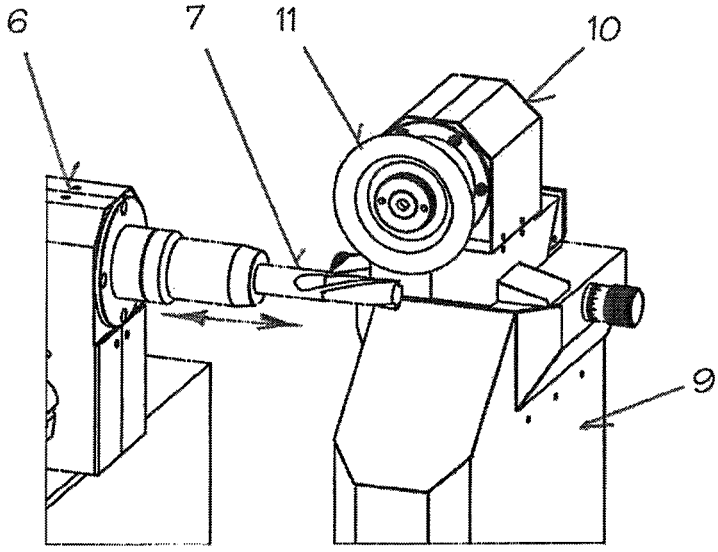
FIG. 4 is a perspective view, but from another viewpoint, of the same region shown in the preceding figure.
Figure 5:
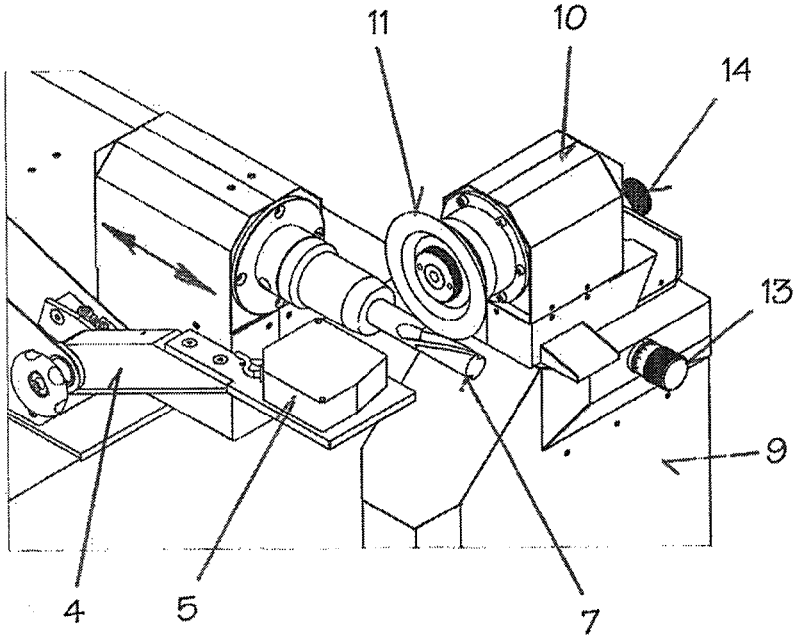
FIG. 5 is a perspective view of the optical reading assembly of the end mill in a position which is shifted toward the end of the helical cutting edges on the lateral surface of the mill.
Figure 6:
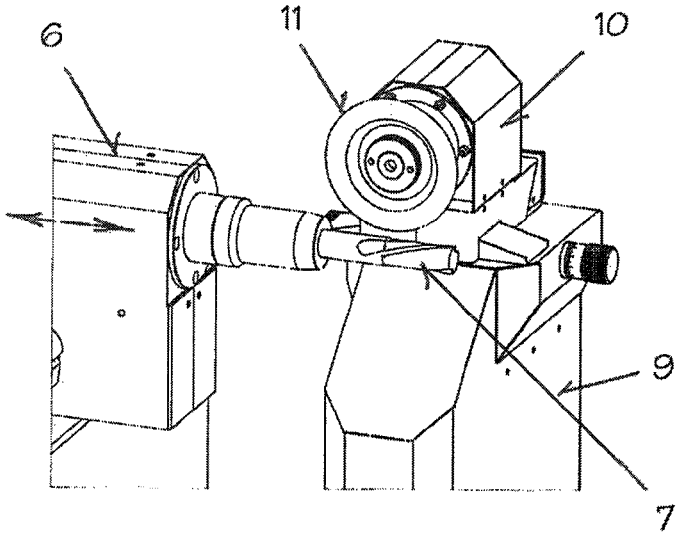
FIG. 6 is a perspective view, but from another viewpoint, of the same region shown in the preceding figure.
Figure 7:
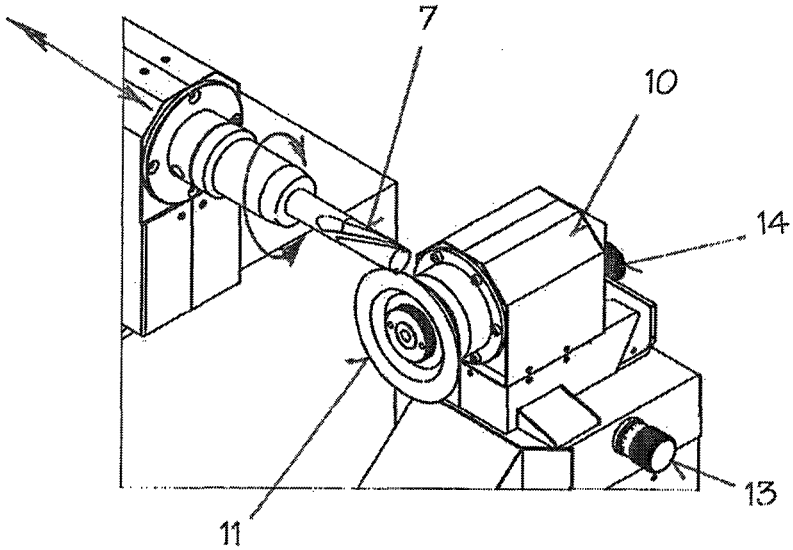
FIG. 7 is a perspective view of the mill assembly arranged below the end mill during the sharpening of the helical cutting edge that is opposite to the upper one.
Figure 8:
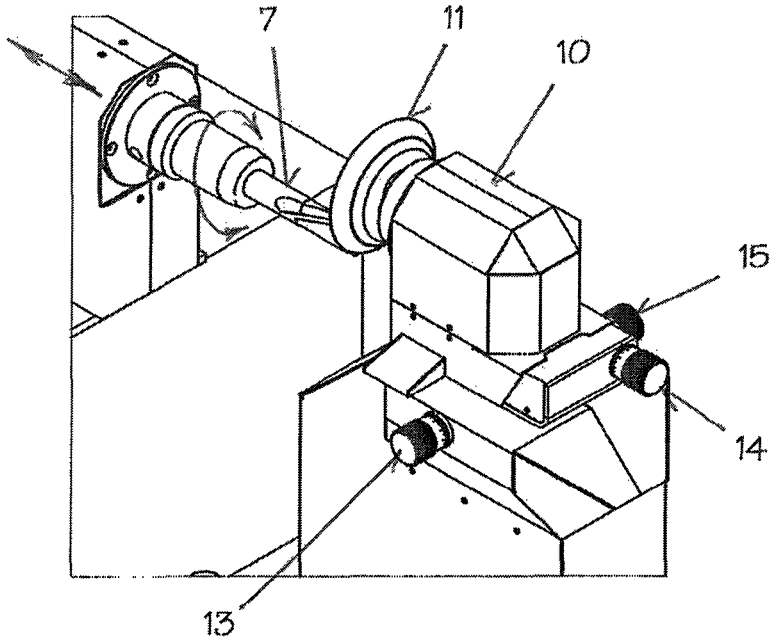
FIG. 8 is a perspective view of the cup grinding wheel assembly in a front position with respect to the end mill to be sharpened, illustrating the three adjustment knobs of said assembly.
Figure 9:
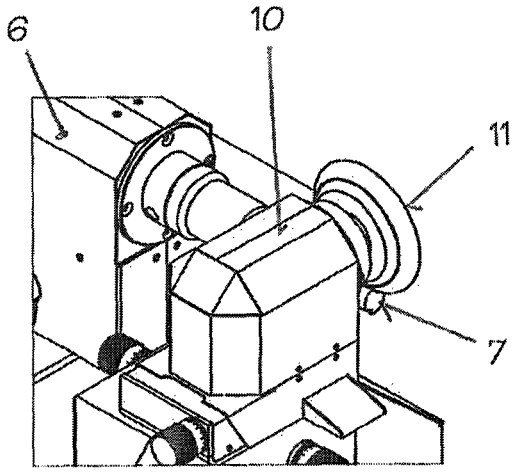
FIG. 9 is a perspective view of the cup grinding wheel assembly in the left and upper position with respect to the end mill to be sharpened, and in this case the mill type is left-handed.
Figure 10:
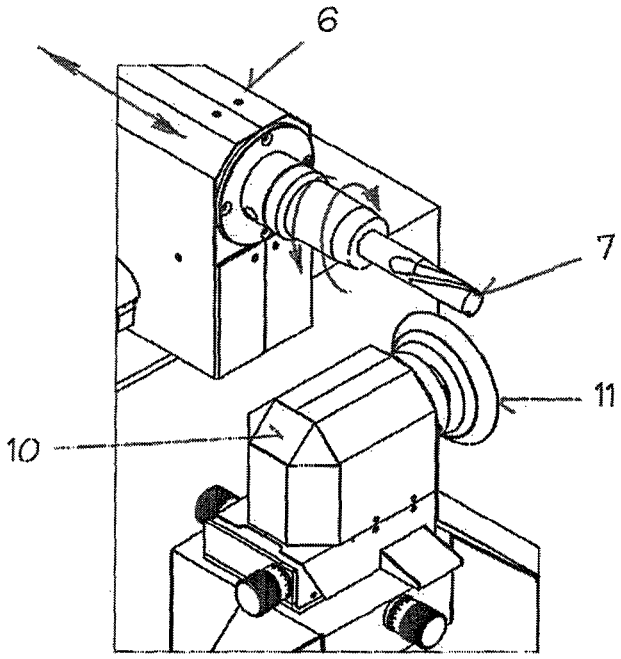
FIG. 10 is a perspective view of the cup grinding wheel assembly in the left and lower position with respect to the mill for sharpening the lower helical cutting edge.

As can be seen from the accompanying figures, the automatic grinding machine 1 for end mills 7 for wood is very compact and can be used in a fixed manner, rested on a bench or mounted on an adapted trolley to facilitate movements within the departments where it can be used to serve other chip-forming machines which use said mills. Of course, it will be provided with protective transparent shields during its operation.

The automatic grinding machine is provided with computerized means for the management and actuation of the movements and uses software and methods which are known in the art. It has a keypad 2 for entering data or an equivalent technique, with a corresponding screen or display for controlling the work steps, which is mounted on the outer body of the machine. The programming language used is the standard ISO for CNC.

A first element that characterizes the machine is the automatic optical assembly 3 for reading the geometric configuration of the end mill for wood 7, which is provided with a movable arm 4, which moves the optical detector 5 from an inactive position to a reading position in the various positions with respect to the end mill (e.g., end, central and final), so as to detect more assuredly the geometric characteristics of said mill; in turn, these data are reported to the programmed computer system. Once the geometrical reading of the mill 7 has been performed, the arm repositions the detector in the inactive position, remote from the mill, and the machine is ready to start the sharpening steps.

The end mill 7 is mounted on an adapted support 6, which is mounted on a slider which moves on command longitudinally to the machine in a horizontal position. Said support is actuated automatically by the computerized automation system both for linear movement and for simultaneous angular rotation according to the type of mill, with left-handed or right-handed helix.

The automatic grinding machine 1 has a single cup grinding wheel 11, which is contoured and adapted to sharpen end mills, which is mounted on a frame 9 which rests on a horizontal base 8 which rotates with a vertical axis, which can be adjusted angularly with a knob and a micrometric screw 16 and locking levers 12. The frame can rise or lower so as to arrange the grinding wheel above and/or below and/or in front and move on the two sides, to the right or to the left of the mill. Moreover, the grinding wheel assembly comprises a grinding wheel holder support 10, which of course is motorized and mounted on adapted sliders so that it can be adjusted exactly on the three axes by virtue of the adapted knobs and respective micrometric screws 13, 14, 15.

Automatic sharpening begins with the insertion of the end mill to be sharpened 7 in the mill holder 6; then the optical reading device 5 is moved and detects at least at three points the geometric configuration of the mill, the data of which are processed automatically by the computerized system (e.g., right-handed or left-handed mill, dimensions and angle of the lateral and front helical cutting edges), and the cup grinding wheel 11 is arranged, again automatically and/or manually, in the working position to perform the desired sharpening. For sharpening the upper helix of the mill, the grinding wheel arranges itself above it, or in a downward region to sharpen the lower helix of the mill, to the right of the mill for the right-handed type and to the left for the left-handed type. In a front position and almost at right angles to the mill axis to sharpen the front cutting edges.

The invention of course is not limited to the example of embodiment described above, starting from which it is possible to provide other embodiments and other ways of carrying it out, and the details of execution may in any case vary without thereby abandoning the essence of the invention as stated and claimed hereinafter.

The invention claimed is:

1. An automatic grinding machine (1) for end mills (7) for wood, which is programmable with optical reading of geometric features and for computerized sharpening, is compact, is configured to be mounted in a fixed manner on a workbench or on an adapted trolley to be easily movable in work departments comprising:

a computerized programmable system according to ISO standard for computer numerical control (CNC) operation said computer programmable system comprising operating software;

a keypad having a display, which is fixed on a body of the automatic grinding machine, said computerized programming system being configured to actuate in cooperation and coordination a first, second and third assembly of the automatic grinding machine;

a first assembly (5) configured to provide automatic optical reading, said first assembly being mounted on an arm movable from an inactive position (3) to an active position proximate to an end mill to be sharpened, wherein once geometric features of said end mill have been detected, said geometric features are processed by the computerized programmable system, which actuates movements of the second and third assemblies;

a second assembly (6) configured to support the end mill (7) in a horizontal position, in longitudinal relation to the automatic grinding machine, said second assembly being configured to advance and simultaneously rotate the end mill along an axis thereof; and a third assembly (10) configured to support a cup grinding wheel (11), said third assembly being mounted on a vertical movable frame (9) positioned on a circular base (8) that is rotatable on a horizontal plane through 360°, so as to arrange said cup grinding wheel to the right, left, above, below, or in front of said end mill;

wherein the cup grinding wheel is equipped so as to be adjusted in three spatial directions of space by means of three knobs (13, 14, 15) which are connected to adapted micrometric screws.

2. The automatic grinding machine for end mills for wood according to claim 1, wherein the second assembly (6) is mounted on a rectilinear slider, which is configured to translate longitudinally and horizontally in relation to the automatic grinding machine and is moved on command forward and backward during simultaneous rotation of the end mill.

3. The automatic grinding machine for end mills for wood according to claim 1, wherein the second assembly (6) is configured to remain stationary when the end mill (7) moves on command forward and backward or simultaneously rotates.

4. The automatic grinding machine for end mills for wood according to claim 1, wherein the third assembly (10) is configured to move automatically or manually between opposite sides of the end mill to be sharpened, according to whether the end mill has a right or left oriented helix, and wherein, in manual mode, the third assembly (10) is oriented with respect to the end mill to be sharpened using an angular adjustment knob (16) of the circular base (8).

5. The automatic grinding machine for end mills for wood according to claim 4, wherein the third assembly (10) is further configured to be oriented with respect to the end mill (7) using three three-dimensional guides which are adjustable with micrometric screws and corresponding actuation knobs (13, 14, 15).

* * * * *